US007959794B2

(12) United States Patent
Galeazzi et al.

(10) Patent No.: US 7,959,794 B2
(45) Date of Patent: Jun. 14, 2011

(54) HYDRODESULPHURISATION METHOD COMPRISING A STRIPPING SECTION AND A VACUUM FRACTIONATION SECTION

(75) Inventors: Renaud Galeazzi, Paris (FR); Alain Dunet, Massy (FR)

(73) Assignee: IFP, Rueil-Malmaison Cedex (FR)

( * ) Notice: Subject to any disclaimer, the term of this patent is extended or adjusted under 35 U.S.C. 154(b) by 1099 days.

(21) Appl. No.: 10/492,368

(22) PCT Filed: Sep. 9, 2002

(86) PCT No.: PCT/FR02/03051

§ 371 (c)(1),
(2), (4) Date: Oct. 4, 2004

(87) PCT Pub. No.: WO03/042332

PCT Pub. Date: May 22, 2003

(65) Prior Publication Data

US 2005/0035028 A1 Feb. 17, 2005

Related U.S. Application Data

(60) Provisional application No. 60/331,572, filed on Nov. 20, 2001.

(30) Foreign Application Priority Data

Oct. 12, 2001 (FR) ..... 01 13151

(51) Int. Cl.
*C10G 45/00* (2006.01)
*C10G 45/04* (2006.01)
*C10G 45/60* (2006.01)

(52) U.S. Cl. ..... 208/213; 208/208 R; 208/212; 208/89

(58) Field of Classification Search ..... 208/213, 208/208 R, 80, 86, 89, 107, 212
See application file for complete search history.

(56) References Cited

U.S. PATENT DOCUMENTS 3,003,950 A * 10/1961 Van Ingen ..... 208/89
3,382,168 A * 5/1968 Wood et al. ..... 208/264
3,471,397 A * 10/1969 Fortman ..... 208/111.3
3,472,758 A * 10/1969 Schoenfeld et al. ..... 208/59
(Continued)

FOREIGN PATENT DOCUMENTS

WO 98 42804 10/1998
(Continued)

OTHER PUBLICATIONS

Tsai; Ming-Chang, Chen; Yu-Wen, Kang; Ben-Chang, Wu; Jung-Chung, Leu; Li-Jen, Hydrodesulfurization and Hydrodemetalation Reactions of Residue Oils over CoMo/Aluminum Borate Catalysts in a Trickle Bed Reactor, Mar. 22, 1991, American Chemical Society, 30, 1801-1810.*

*Primary Examiner* — Walter D Griffin
*Assistant Examiner* — Natasha Young
(74) *Attorney, Agent, or Firm* — Millen, White, Zelano & Branigan, P.C.

(57) ABSTRACT

The invention concerns a facility and a process for hydrodesulphurizing gas oil or vacuum distillate comprising at least one hydrodesulphurization reaction section, at least one stripping section and at least one fractionation section in which the fractionation section comprises at least one fractionation column operated under moderate vacuum.

10 Claims, 1 Drawing Sheet

Figure 1:
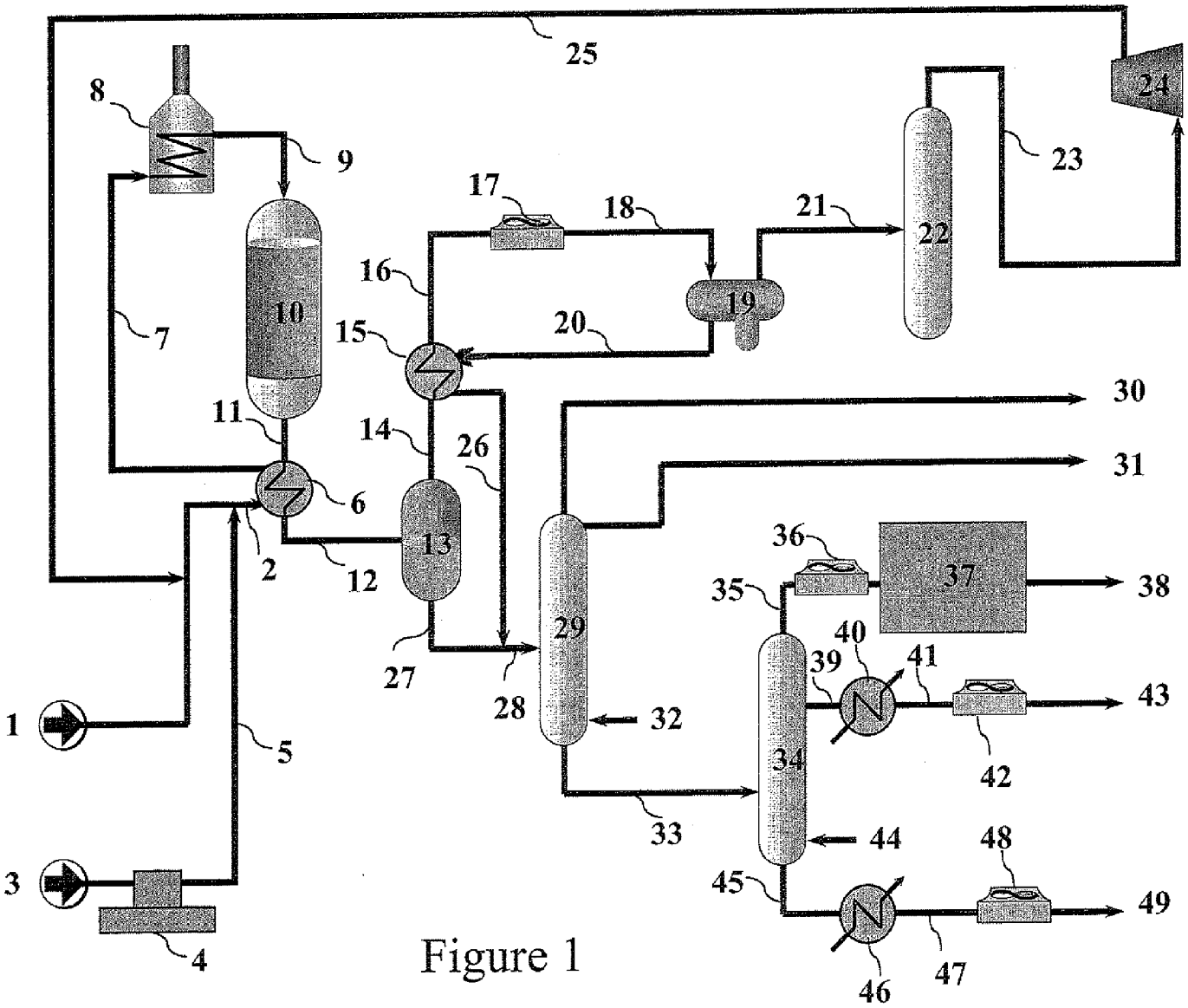

U.S. PATENT DOCUMENTS 3,718,577 A * 2/1973 Nai et al. ..... 208/108
3,733,260 A 5/1973 Davies et al.
3,926,784 A 12/1975 Christman et al.
4,062,762 A * 12/1977 Howard et al. ..... 208/211
4,391,700 A * 7/1983 Billon et al. ..... 208/86
4,521,295 A * 6/1985 Chervenak et al. ..... 208/59
4,808,289 A 2/1989 McDaniel et al.
5,120,427 A * 6/1992 Stine et al. ..... 208/102
5,338,436 A * 8/1994 Harandi ..... 208/80
5,968,347 A 10/1999 Harrison et al.
6,083,378 A * 7/2000 Gildert et al. ..... 208/209

FOREIGN PATENT DOCUMENTS

WO WO9842804 * 10/1998

* cited by examiner

HYDRODESULPHURISATION METHOD COMPRISING A STRIPPING SECTION AND A VACUUM FRACTIONATION SECTION

This application claims the benefit of Provisional Application Ser. No. 60/331,572, filed Nov. 20, 2001.

PRIOR ART

Conventional processes for hydrodesulphurising gas oils or vacuum distillates comprise a still generally located between the $H_2S$ stripper and the principal fraction column. The presence of this still allows temperatures to be raised after stripping and produces efficient fractionation in the downstream fractionation column. However, the presence of the still causes high energy consumption and represents a considerable investment and high operating costs both for the facility per se and compared with the whole of the process.

SUBJECT MATTER OF THE INVENTION

The present invention relates to a process for hydrodesulphurising a gas oil or vacuum distillate, preferably a vacuum gas oil and/or vacuum distillate, comprising at least one hydrodesulphurization reaction section, at least one stripping section and at least one fractionation section in which the principal fractionation column is operated under a medium vacuum. The process of the invention can reduce the quantity of heat to be supplied to the feed in the fractionation section and thus means that that section can be operated at moderate temperatures. The process of the invention can thus desulphurise a gas oil or a vacuum distillate without the need to install a still between the stripping section and the fractionation section, representing a substantial economic advantage compared with prior art processes.

DETAILED DESCRIPTION OF THE INVENTION

The present invention concerns a process and a facility for hydrodesulphurising a gas oil or vacuum distillate, preferably a vacuum gas oil and/or vacuum distillate, comprising at least one hydrodesulphurization reaction section, at least one stripping section and at least one fractionation section in which the principal fractionation column is operated under a medium vacuum. Preferably, the facility of the invention also comprises a hot separator drum.

In the process and facility of the invention, the hydrodesulphurization reaction section can comprise one or more reactors disposed in series or in parallel, for example two reactors disposed in series. Each reactor in the reaction section comprises at least one catalyst bed. The catalyst can be employed in a fixed bed or in an expanded bed, or again as an ebullated bed. With a catalyst employed in a fixed bed, it is possible to provide a plurality of catalyst beds on at least one reactor.

Any catalyst that is known to the skilled person can be used in the process of the invention, for example a catalyst comprising at least one element selected from elements from group VIII of the periodic table (groups 8, 9 and 10 of the new periodic table) and optionally at least one element selected from elements from group VIB of the periodic table (group 6 of the new periodic table).

The operating conditions in this hydrodesulphurization reaction section generally fall into the operating condition ranges described in the prior art. Said operating conditions that can be used in hydrotreatment are well known in the art:

The temperature is typically in the range for about 200° C. to about 460° C.

The total pressure is typically in the range from about 1 MPa to about 20 MPa, generally in the range 2 to 20 MPa, preferably in the range 2.5 to 18 MPa, and highly preferably in the range 3 to 18 MPa.

The overall hourly space velocity for the liquid feed for each catalytic step is typically in the range about 0.1 to about 12, and generally in the range from about 0.4 to about 10.

The purity of the hydrogen used in the process of the invention is typically in the range 50 to 99.9.

The quantity of hydrogen with respect to the liquid feed is typically in the range from about 50 to about 1200 $Nm^3/m^3$.

The fractionation and stripping sections can be provided with any type of stripping column at any pressure or with moderate vacuum fractionation, as is known to the skilled person. Stripping can be carried out using any stripping gas such as a gas containing hydrogen or steam. Preferably, steam is used to carry out said stripping. The vacuum column is also preferably supplied with at least one stripping gas, preferably steam.

Passage through the column under moderate vacuum, i.e., generally in the flash zone in the range 0.05 bars to 0.95 bars (1 bar=0.1 MPa), preferably in the range 0.1 bars to 0.90 bars, more preferably in the range 0.1 bars to 0.7 bars and still more preferably in the range 0.15 bars to 0.5 bars, can considerably reduce the heat to be supplied to the feed for this column to vaporize the light fraction from hydrocarbon conversion reactions in the hydrodesulphurization reactor.

When the facility of the invention comprises a hot separator drum, the additional heat necessary for said vaporization can optionally be supplied by increasing the temperature of said separator drum compared with the current practice which corresponds to a temperature that is generally in the range 240° C. to 280° C. Generally, this increase is less than 60° C., preferably less than 50° C., more preferably less than 40° C. This mode of operation also differs substantially from that of the prior art in which the temperature of the hot drum is fixed for the operation of the $H_2S$ stripper column. The temperature of said separator drum, when it is present, is thus generally in the range 280° C. to 350° C., preferably in the range 300° C. to 340° C. and more preferably in the range 300° C. to 330° C.

Thus, we can profit from this temperature elevation to distill a maximum amount of naphtha in the stripper and thus send compounds with a boiling point that is generally more than about 100° C. to the principal fractionation column. The absence of light compounds in the vacuum column can produce complete condensation of the overhead product with a very moderate vacuum (for example 0.1 to 0.5 bars absolute).

Any other mode for supplying additional heat other than a still can, however, be envisaged in the process of the invention, in particular those known to the skilled person such as a supplemental heat exchanger.

In the process of the invention, the temperature of the vacuum system is generally governed by the condensation temperature of the water deriving from the stripping steam in the column. Complete condensation of the hydrocarbons and steam enables a very simple vacuum system that consumes little energy to be used.

From an energetic viewpoint, this process can usually save about ⅔ of the energy consumption of the still used in prior art processes. The remaining ⅓ is taken up by the still of the reaction loop.

Regarding the equipment, this process can dispense with the still and some of the cooling exchangers that are normally necessary before recovering the products from the process. The vacuum column operates under a moderate vacuum, i.e., generally in the range 0.05 bars to 0.95 bars in the flash zone (1 bar=0.1 MPa). These vacuum operations, therefore, do not result in high overcosts. A further substantial simplification is the preferred possibility of dispensing with side strippers in this column, as extracting a large quantity of naphtha in the stripper can produce kerosene and gas oil cuts with good specifications as regards the flash point, in general in the range 50° C. to 70° C.

FIG. 1 describes one possible implementation of the process of the invention. This embodiment is particularly suitable when conversion of the feed in the hydrodesulphurization reaction section is limited to less than 50% (i.e., less than 50% by weight of the feed is converted in this section), preferably to less than 30%.

The feed, for example a vacuum gas oil comprising hydrocarbons with boiling points in the range 370° C. to 565° C., is supplied via a line 1. Hydrogen, preferably in excess with respect to the feed, is supplied via a line 3 and the compressor 4 then the line 5, and mixed with feed 1 before being admitted into a feed-effluent exchanger (6) via line 2. Exchanger 6 can pre-heat the feed using the effluent from a hydrodesulphurization reactor 10. After exchange, the feed is supplied via a line 7 to a still that can heat it to the temperature necessary for the hydrodesulphurization reaction, then the hot feed is sent via a line 9 to hydrodesulphurization section 10 constituted by at least one hydrodesulphurization reactor comprising at least one hydrodesulphurization catalyst.

The effluent from reactor 10 is sent to exchanger 6 then via a line 12 to a separator drum 13. a gas fraction is separated in this drum and recovered via a line 14. The desulphurised liquid fraction is recovered from the bottom via a line 27. Said gas fraction comprises unreacted hydrogen, hydrogen sulphide ($H_2S$) formed during the reaction and generally, light hydrocarbons from converting hydrocarbons in the feed in the hydrodesulphurization reaction section. After cooling in an exchanger 15 and an air condenser 17, this fraction is supplied via, a line 18 to a flash drum that can both carry out gas-liquid separation and decant the aqueous liquid phase. The liquid hydrocarbon phase is recycled via lines 20 and 26 to the liquid effluent from drum 13 and mixed with this liquid effluent before being sent via line 28 to a stripping column (stripper) 29.

The gas fraction from flash drum 19 is sent via a line 21 to an amine absorber or a washing column 22 to eliminate at least a portion of the $H_2S$, then the gas fraction containing hydrogen is recycled via lines 23 and 25 to the hydrodesulphurization reactor after compression using a compressor 24, and mixed with feed 1.

Stripper 29 is preferably supplied with stripping steam via a line 32. A gas fraction (generally termed the acid gas) is recovered overhead from the stripper via a line 30 and via a line 31 a naphtha with an end point that is usually more than 100° C. The liquid recovered from the bottom of the stripper via a line 33 is sent to a fractionation column 34 without the need to reheat it in a still or exchanger.

Fractionation column 34 is operated under vacuum. It is generally a moderate vacuum (for example about 0.25 bars in the flash zone). Operating the column under a moderate vacuum can considerably reduce the heat to be supplied to the feed for this column to vaporize the fraction with a boiling point of less than 370° C. The additional heat is preferably supplied by increasing the temperature of the hot separator drum (13) by a relatively small amount compared with normal practice (for example about 310° C. instead of 270° C.). This vacuum column is also supplied with stripping steam via a line 44.

The overhead fraction recovered via line 35 is essentially free of light products and after cooling in an air condenser 36, this fraction can readily be condensed under a moderate vacuum: about 0.1 to 0.7 bars absolute, preferably about 0.1 to 0.5 bars absolute (1 bar=0.1 MPa). As an example, it is possible to operate with an outlet temperature from the air condenser (36) of 52° C., namely 0.14 bars of steam pressure.

In a separation and vacuum maintenance section 37, details of which are not shown as they are known to the skilled person, it is possible to separate an aqueous liquid fraction and a hydrocarbon fraction which is not to be recovered via line 38. The product obtained from line 38 is, for example, constituted by naphtha and/or kerosene and/or gas oil cuts with an initial boiling point of more than 100° C. Said section 37 also comprises equipment that can generate a partial vacuum and maintain it in the column; any equipment that is known to the skilled person can be used, for example an ejector and a condenser or a vacuum pump.

The intermediate fraction leaving the fractionation column via a line 39 is cooled, for example in an exchanger (40) and an air condenser (42), then recovered via a line 43. This, for example, is a gas oil cut with an end point of less than 370° C.

The heavy fraction leaving the. fractionation column via a line 45 is also cooled, for example using an exchanger 46 and air condenser 48. The fraction obtained via a line 49 is a hydrotreated vacuum gas oil with cut points close to the initial feed (for example initial boiling and end points of 370° C. and 565° C. respectively).

In a further preferred implementation, it is possible to recover a fraction covering naphtha to light gas oil (for example with an end point of less than 370° C.) via line 38, and a complementary heavy gas oil fraction (for example with an initial boiling point of more than 370° C.) via line 49. In this case, the fractionation column does not include intermediate fractionation and lines 39 to 43 are absent.

The invention claimed is:

1. A process for hydrodesulphurising a gas oil or vacuum distillate, comprising subjecting said gas oil or vacuum distillate to hydrodesulfurization conditions in at least one hydrodesulphurization reaction section (10), passing effluent from (10) to a separator drum (13), operated at a controlled temperature in the range of 280°-350° C. combining liquid effluent from (13) and liquid hydrocarbon phase (20) from a flash drum (19) and sending said combined liquid effluent (15) and liquid hydrocarbon phase (20) to at least one stripping section (29) to recover a gas fraction in line (30) overhead from the stripping section, a naphtha in line (31) with an end point that is more than 100° C., and to decant an aqueous liquid phase in line (33) from the bottom of the stripping section, passing liquid effluent from (29) to at least one fractionation section (34) in which said fractionation section comprises at least one fractionation column operated under a moderate vacuum, and a pressure of 0.05 to 0.95 bars and in which in the fractionation section the desulphurised liquid effluent from the stripping section is separated into at least 3 fractions: a fraction covering naphtha to kerosene with an end point in the range from about 160° C. to about 180° C., a light gas oil fraction with an end point in the range from about 350° C. to about 380° C. and a heavy gas oil fraction with an initial boiling point in the range from about 350° C. to about 370° C., said separator drum (13) being located between the hydrodesulphurization reaction section (10) and the stripping section (29), the liquid hydrocarbon phase (20) being recycled and mixed with the liquid effluent from drum (13) via an exchanger (6), and a gas phase (21) from said flash drum (19) being recycled to the hydrodesulphurization reaction section (10), wherein the liquid effluent is not passed through a still between the stripping section (29) and the fractionation section (34).

2. A process according to claim 1, in which in said fractionation section the desulphurised liquid effluent from the stripping section is separated into at least 2 fractions: a fraction encompassing naphtha to light gas oil and a heavy gas oil fraction.

3. A process according to claim 1, in which in the reaction section hydrodesulfurization is conducted in two hydrodesulphurization reactors in series.

4. A process for hydrodesulfurization of a gas oil or vacuum distillate comprising:

Feeding said gas oil or vacuum distillate (1,2) to a hydrodesulphurization section comprising at least one hydrodesulphurization reactor;

feeding at least one hydrogen-containing gas supply (3, 5, 2) to said hydrodesulphurization section;

pre-heating the feed in a feed-effluent exchanger (6) using the effluent from the hydrodesulphurization reactor;

pretreating said gas oil or vacuum distillate in at least one still (8) located upstream of said hydrodesulphurization section;

separating effluent from said hydrodesulfurization section in at least one separator drum (13) operated at a controlled temperature in the range of 280° to 350° C., located downstream of the hydrodesulphurization into and in which in the fractionation section the desulphurised liquid effluent from the stripping section is separated into at least 3 fractions: a fraction covering naphtha to kerosene with an end point in the range from about 160° C. to about 180° C., a light gas oil fraction with an end point in the range from about 350° C. to about 380° C. and a heavy gas oil fraction with an initial boiling point in the range from about 350° C. to about 370° C.;

stripping a combined desulphurised liquid fraction (27, 28) from said separator drum (13) and liquid hydrocarbon recycle from a flash drum (19), with a stripping steam (32) in at least one stripping column (29);

fractionating a liquid fraction (33) from the stripping column (32), in at least one fractionation column (34) optionally by stripping steam (44);

and generating and maintaining a vacuum in at least one section (37), wherein in said process effluent passing between the stripping column (29) and the fractionation section (34) does not pass through a still.

5. A process according to claim 3, further comprising eliminating at least a portion of the $H_2S$ formed in the hydrodesulphurization section and present in said gas phase.

6. A process according to claim 5, comprising eliminating $H_2S$ in an amine absorber or a washing column (22).

7. A hydrodesulphurization process according to claim 1, in which said hot separator drum is operated at a temperature in the range 300° C. to 330° C.

8. A hydrodesulphurization process according to claim 1, in which the fractionation section comprises a fractionation column operated at a pressure in the range 0.15 to 0.5 bars.

9. A hydrodesulphurization process according to claim 1, in which the hydrodesulphurization reaction section comprises at least one reactor charged with at least one hydrodesulphurization catalyst.

10. A process according to claim 9, in which said catalyst comprises at least one element selected from elements from group VIII and elements from group VIB of the periodic table.

* * * * *